US007302968B2

(12) United States Patent
Stuart

(10) Patent No.: US 7,302,968 B2
(45) Date of Patent: Dec. 4, 2007

(54) FILL TUBE DIFFUSER FOR FUEL STORAGE TANKS

(75) Inventor: Graham Mansfield Stuart, Redhill (GB)

(73) Assignee: Risbridger Limited (GB)

( * ) Notice: Subject to any disclaimer, the term of this patent is extended or adjusted under 35 U.S.C. 154(b) by 335 days.

(21) Appl. No.: 10/466,009

(22) PCT Filed: Nov. 29, 2002

(86) PCT No.: PCT/GB02/05413

§ 371 (c)(1),
(2), (4) Date: Dec. 29, 2003

(87) PCT Pub. No.: WO03/048009

PCT Pub. Date: Jun. 12, 2003

(65) Prior Publication Data

US 2004/0079420 A1 Apr. 29, 2004

(30) Foreign Application Priority Data

Nov. 29, 2001 (GB) ..... 0128627.7

(51) Int. Cl.
*B05B 1/14* (2006.01)

(52) U.S. Cl. ..... 137/592; 239/555; 239/590; 141/286

(58) Field of Classification Search ..... 137/592, 137/590, 558; 73/290 R; 116/227; 239/554, 239/555, 590, 590.5; 141/286, 370; 144/382
See application file for complete search history.

(56) References Cited

U.S. PATENT DOCUMENTS

| | | | | |
|---|---|---|---|---|
| 1,155,070 | A * | 9/1915 | Kesler | 220/86.2 |
| 2,602,465 | A * | 7/1952 | Goehring | 137/582 |
| 3,528,614 | A * | 9/1970 | Honmann | 239/602 |
| 3,552,435 | A * | 1/1971 | Andersson et al. | 137/592 |
| 4,340,009 | A * | 7/1982 | Greaves, Jr. | 116/227 |
| 5,893,521 | A * | 4/1999 | Bertain | 239/11 |
| 5,947,153 | A * | 9/1999 | Bucci et al. | 137/588 |
| 5,984,211 | A * | 11/1999 | Sugimoto et al. | 239/596 |
| 6,058,968 | A * | 5/2000 | Carter | 137/561 A |
| 6,138,614 | A * | 10/2000 | Shropshire | 122/13.3 |
| 6,234,200 | B1 * | 5/2001 | Hall | 137/590 |
| 6,360,970 | B1 * | 3/2002 | Fitzgerald | 239/499 |

FOREIGN PATENT DOCUMENTS

GB 2344582 A * 6/2000

* cited by examiner

*Primary Examiner*—Eric Keasel
*Assistant Examiner*—Craig Schneider
(74) *Attorney, Agent, or Firm*—Andrus, Sceales, Starke & Sawall, LLP

(57) ABSTRACT

A flow diffuser adapted to be fitted to the exit end of the fill tube of a fuel tank having slot like apertures which are arranged to extend substantially at right angles to the axis of the fill. A deflector is fitted into the base of the diffuser and is formed with an opening to allow the passage of a dipstick.

3 Claims, 6 Drawing Sheets

FILL TUBE DIFFUSER FOR FUEL STORAGE TANKS

CROSS-REFERENCE TO RELATED APPLICATION

The present invention asserts priority on Great Britain Patent Appln. PCT/GB02/05413, filed 29 Nov. 2001.

FIELD OF THE INVENTION

This invention relates to fuel storage tanks, and particularly, to storage tanks having fill tubes which extend from an upper region, into the tank towards the bottom, so as to allow the tank to be filled whilst maintaining a liquid seal between the fill tube and the contents of the tank.

BACKGROUND OF THE INVENTION

Such fuel tanks are commonly mounted underground, and filled by gravity feed delivery tanker trucks. Delivery flow rates vary over a wide range depending on the tanker compartment fuel level and delivery pipework size and length. In some cases, tanker pipework delivery is assisted by a pump system to reduce delivery time, and the flow rate may vary from approximately 200 to approximately 2,000 liters per minute. At high delivery rates, considerable turbulence can occur below the end of the fill tube, and accordingly it has been proposed to incorporate a diffuser, at the lower end of the fill tube, which is arranged to deflect the flow of fuel in a horizontal direction, instead of allowing it to flow vertically downwards towards the base of the tank.

One known type of diffuser of this kind is shown in British patent no. 2,344,582, and comprises a tubular part which is attached to the lower end of the fill tube, having slot-like apertures in its side walls, and a base which includes a conical shaped deflector. In use, the downwardly flowing fuel is deflected by the sloping sides of the cone so as to leave the diffuser through the slot-like apertures.

In some applications however, operators wish to check the level of fuel in the tank, and also for the presence of water, by inserting a dipstick into the fill tube. As the diffuser is deliberately positioned above the bottom of the tank, the presence of the diffuser will prevent a proper reading of the depth being obtained. In practice, since tanks vary in size, the fill tube/diffuser combination is made to be somewhat shorter than the expected depth of the tank, preventing the effective use of such a dipstick.

SUMMARY OF THE INVENTION

Accordingly, the present invention provides a flow diffuser adapted to be fitted to the exit end of the fill tube of a fuel tank, having slot-like apertures which are arranged to extend substantially at right angles to the axis of the fill tube, and a deflector, in the base of the diffuser; the deflector being formed with an opening to allow the passage of a dip stick and the diffuser also including guide means arranged to guide the end of the dip stick into the opening, when it is inserted in the fill tube.

The opening can also be used, if required, for insertion of a suction tube for water removal.

Preferably, the slot-like apertures are defined by two or more substantially parallel plates disposed substantially at right angles to the longitudinal axis of the fill tube. In a preferred embodiment of the invention, there are multiple parallel slots, formed by a plurality of plates mounted on studs carrying spacers which separate the plates.

The deflector is preferably of a generally conical shape, and the sides of the cone preferably have a smoothly curved profile, which merge into the base so as to improve the smoothness of the flow through the diffuser.

Preferably, the size of the cone is such that its base diameter is substantially the same as that of the base of the diffuser, and the opening for the dip stick comprises a short inner tubular section which intersects the cone and extends parallel to its axis, with the guide means situated above the inlet of the inner tubular section.

In a preferred embodiment, the guide means comprise a plurality of circumferentially spaced, generally radially extending vanes, having inner edges which slope toward the inlet of the inner guide tube.

In a modified form of the invention, an extension of the guide tube is provided, below the base of the diffuser, which may be telescopic so as to engage the base of the tank, in use.

BRIEF DESCRIPTION OF THE DRAWINGS

Some embodiments of the invention will be described, by way of example, with reference to the accompanying drawings in which:

Referring to FIG. 1, a fuel tank 100 is generally mounted underground, and includes a fill tube 102 with a capped tee junction 103 in the case of an offset fill position and an inlet conduit 104 for delivery of fuel from a road tanker. Alternatively, it is often preferred to provide a direct vertical connection to the fill tube (not shown). As shown, the base of the fill tube is cut at an angle of about 45°, so that liquid emanates from the end or the fill tube tends to strike the bottom of the tank obliquely.

Figure 1:
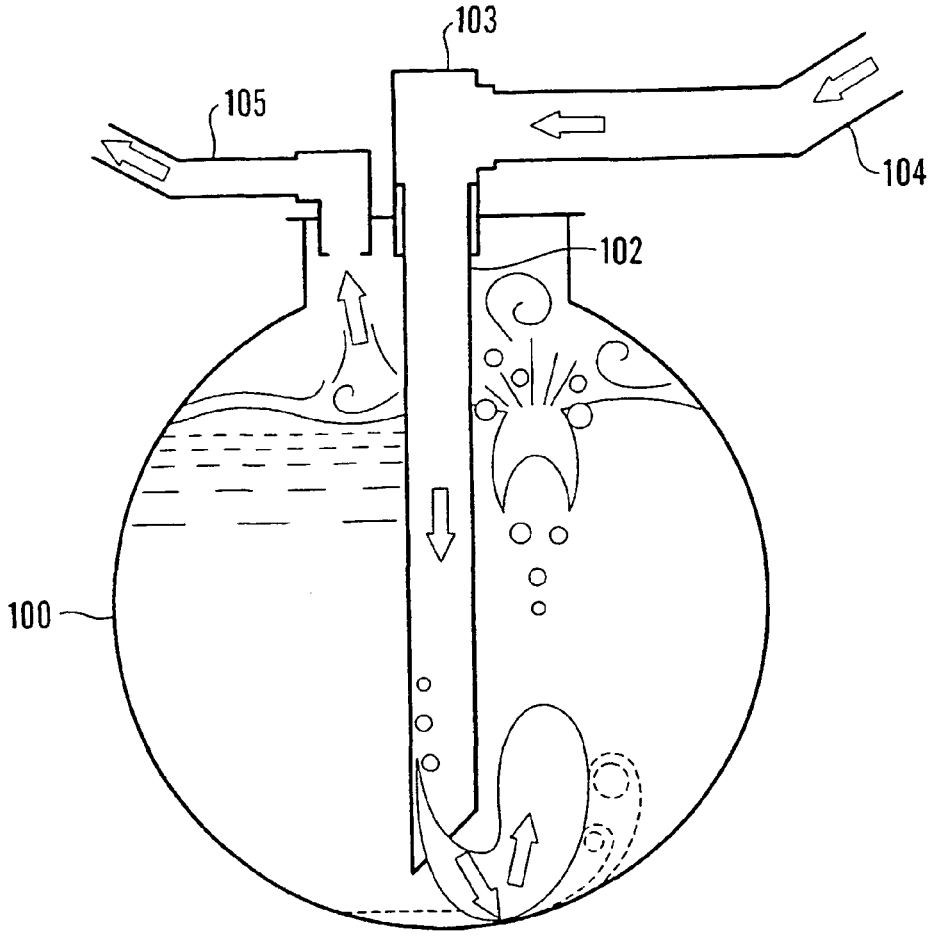
Fig. 1 PRIOR ART
FIG. 1 is a diagrammatic section through a fuel tank showing the fill tube arrangement.

In the initial stage of the delivery of fuel, the air initially present in the delivery hose and inlet line 104 will be compressed by the advancing fuel front and this will cause the generation of large air bubbles as illustrated pictorially in FIG. 1. These bubbles and pockets of air rebound off the tank base and break up the top surface of the liquid in the tank, disrupting the normal vapour level and generating large amounts of additional vapour.

The vapour so produced is vented from the tank via the vent line 105. At the same time, the air and liquid moving at relatively high velocity out of the fill tube 102 will disturb sediment at the bottom of the tank, causing this to be suspended in the fuel. Such sediment can cause difficulties not only for vehicles supplied from the tank, but in the operation of the valves of the filling station itself.

Figure 2:
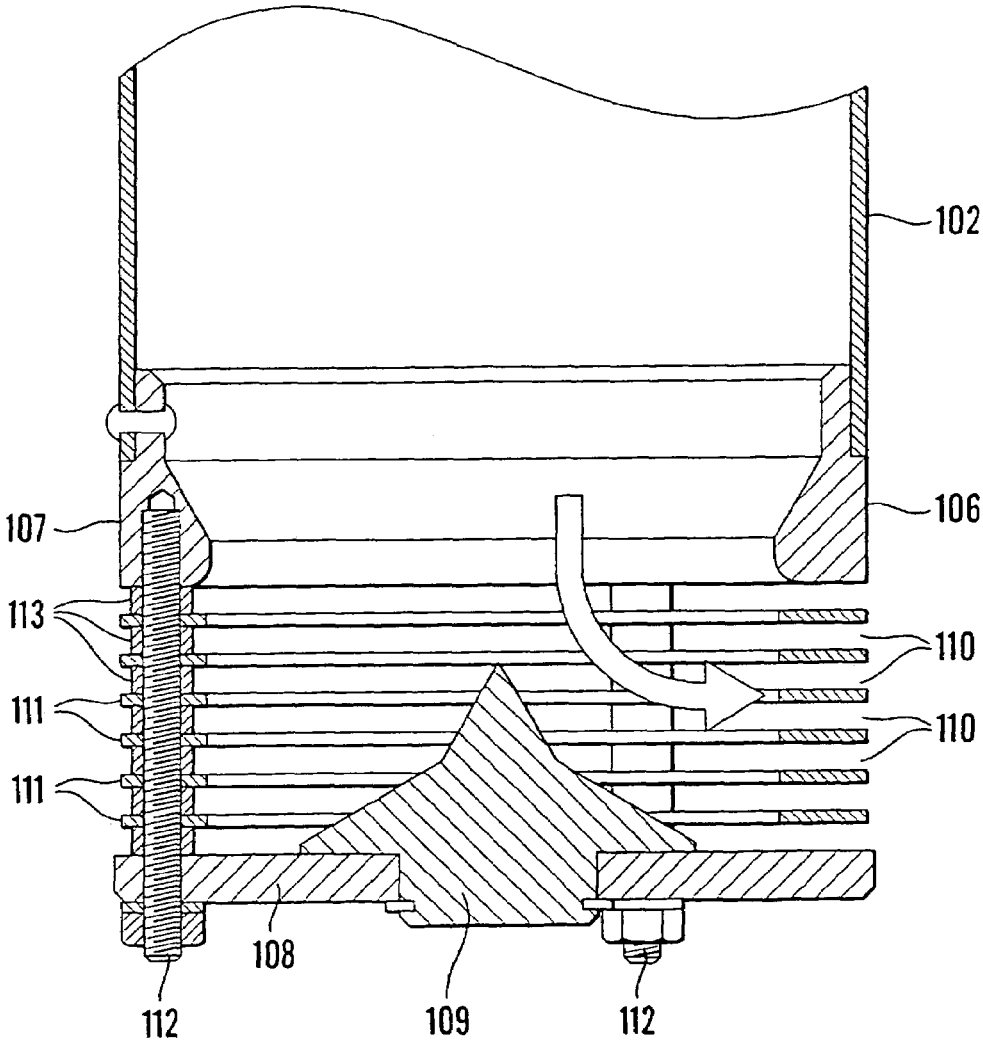
Fig.2 PRIOR ART
FIG. 2 is a vertical cross section through a diffuser mounted in its operative position at the base of the fill tube.

Referring to FIG. 2, this shows the storage tank of FIG. 1 with the fill tube modified and fitted with a diffuser of the kind shown in GB 2 344 582. Diffuser 106 is fitted to the end of the fill tube which is cut off at right angles to its axis rather than at an angle as in FIG. 1. The characteristic of the diffuser 106 is that it includes a closed off lower end 108 and a series of horizontal vanes 111, which promote laminar flow of fuel and air substantially at right angles to the axis of the fill tube. Preferably, the vanes extend around substantially the whole of the circumference of the diffuser, and the effect of the varies is to break up the air pockets into smaller bubbles, and cause much reduced disturbance.

As shown in FIG. 2 the diffuser comprises a tubular part 107 attached to the lower end of the fill tube 102, and having a base 108 which carries a cone-shaped deflector 109. A series of slot-shaped apertures 110 are formed by a series of vanes 111, which are mounted on studs 112, screwed into the tubular part 107. Spacers 113 between the vanes 111 control the size of the slots 110.

Although the diffuser of FIG. 2 has been shown to operate very successfully in preventing the kind of turbulence which occurs in the arrangement of FIG. 1, it is frequently required to gauge the level of fuel in the tank, by inserting a dip stick in the fill tube 102, and it will be appreciated that the presence of base 108 of the diffuser, and central cone, would obstruct the passage of the dip stick and therefore make it more difficult to properly gauge the amount of fuel in the tank.

Figure 3:
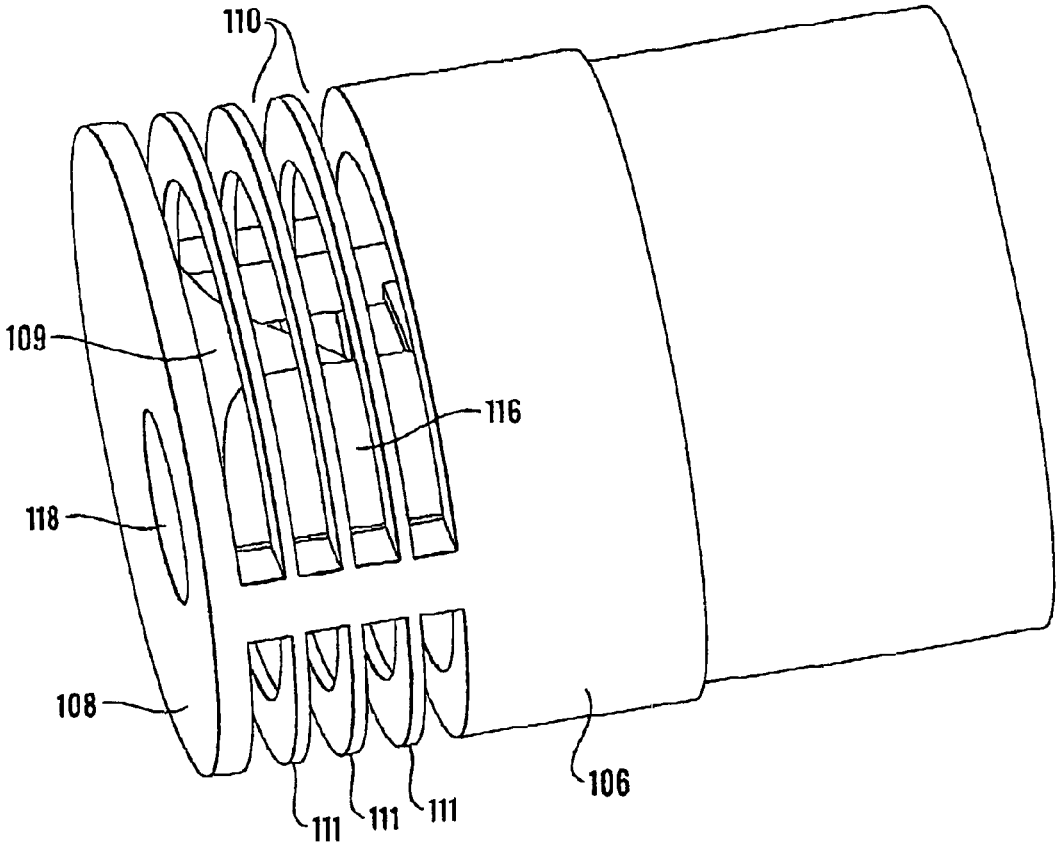
FIG. 3 is a perspective view, from one side, illustrating a first type of diffuser according to the present invention.
Figure 4:
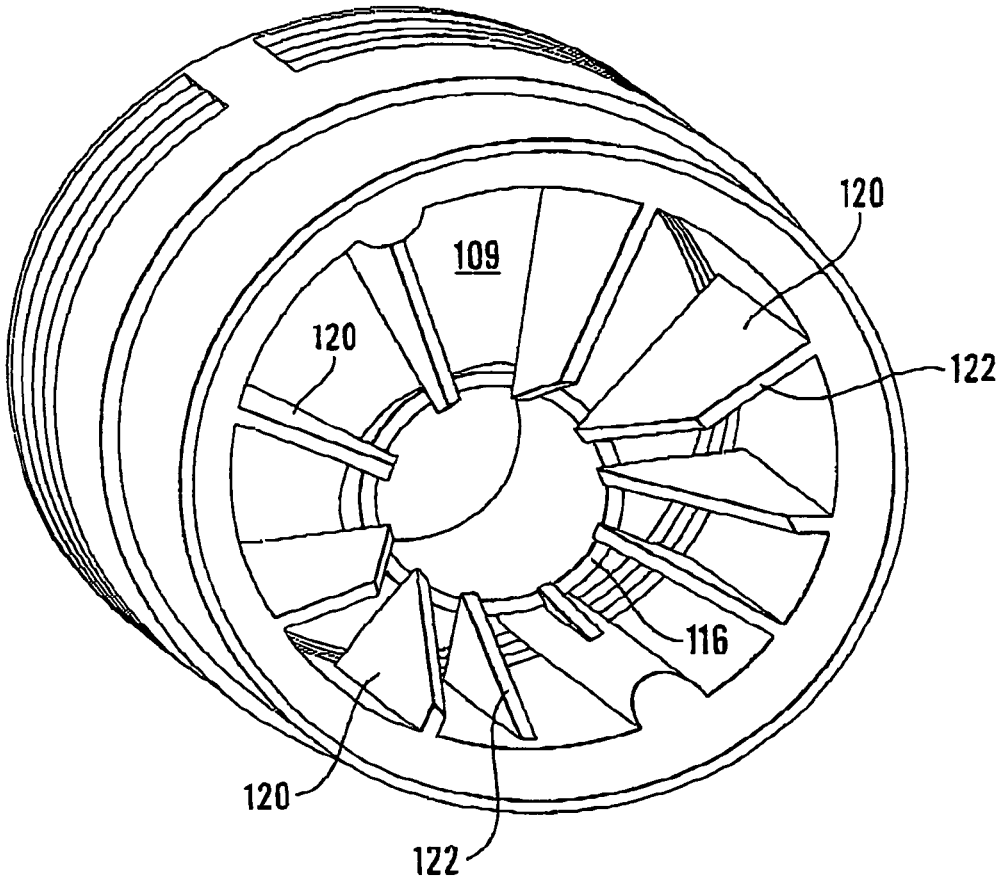
FIG. 4 is a top perspective view of the diffuser of FIG. 3, showing parts of the interior.

Accordingly, as shown in FIGS. 3 and 4, the first embodiment of the present invention provides a diffuser 106 having a generally similar external appearance to the diffuser of FIG. 2, with a plurality of slots 110 formed between vanes 111. In the case of the FIG. 3 embodiment, the vanes 111 are formed by machining an initially solid tube, but of course it will be appreciated that the operational effect is similar to the construction of FIG. 2.

The embodiment of FIG. 3 and 4 differs from the known construction of FIG. 2, primarily in the fact that the central cone 109 is formed with a tubular guideway 116, whose axis is parallel to but offset from the axis of the cone and the fill tube, and forms an exit aperture 118 in the base 108 of the diffuser, so as to allow a dip stick to pass through it. It will also be noted from FIGS. 3 ant 4 that the shape of the cone 109 differs somewhat from that shown in FIG. 2, by having a larger base which covers substantially the whole of the base 108 of the diffuser. It is also formed with sides which slope in a generally hyperbolic profile, so as to merge smoothly into the plane of the base and thus improve the smoothness of flow of fuel out of the diffuser, by avoiding sharp changes in curvature.

Figure 5:
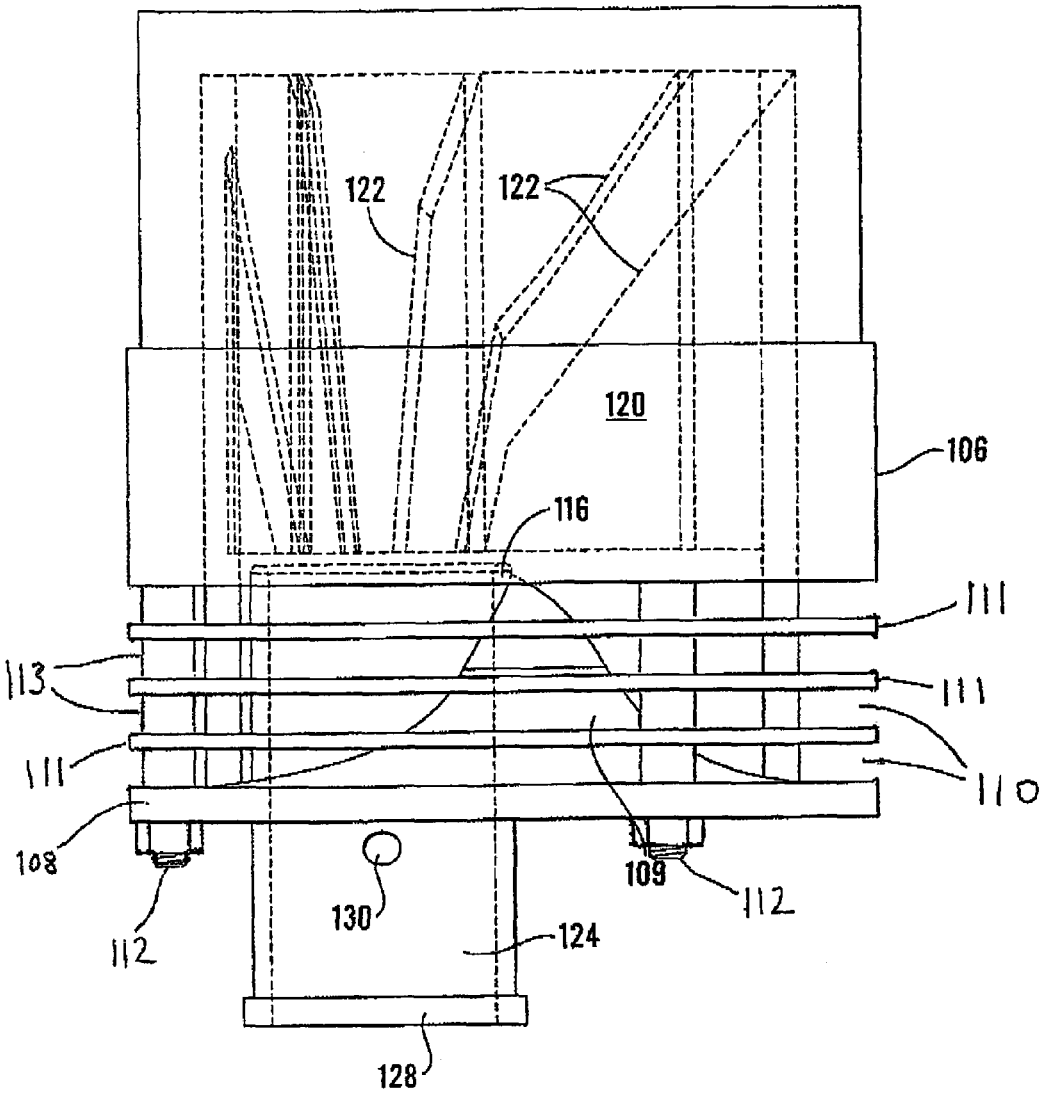
FIG. 5 is a side elevation of a modified form of diffuser according to the present invention.

As will also be apparent from the drawings, and particularly the embodiment of FIG. 5, the guide tube 116 extends upwardly through the body of the cone from the base 108, to a height just above the apex, and its upper end is surrounded by generally radially extending side vanes 120 whose inner edges 122 are sloped, so that when a dip stick is inserted in the fill tube, its lower end will be deflected towards the tube 116. Since the guide vanes are relatively thin, and extend generally radially relative to the axis of the tube 116, they do not significantly obstruct the flow of fluid down the fill tube, and towards the base of the diffuser.

Instead of guide vanes 120, it would of course be possible to utilize any guide construction which provided an equivalent shape without obstructing fluid flow, such as an inverted mesh cone or an inverted conical spring.

In general, in the tank arrangement shown in FIG. 1, an overfill valve will be fitted towards the upper end or the fill tube 102, and this is also adapted to allow the passage of the dip stick down one side. Consequently, of course, when the diffuser is assembled in position, its guide tube 116 must be aligned with the corresponding side of the overfill valve.

Because of the presence of the guide tube 116, of course, some percentage of the fuel flow will pass vertically through the guide tube 116, rather than being deflected in the proper way, through the diffuser vanes. In order to improve the flow characteristics in this respect, the embodiments of FIG. 5 and includes an extension member 124 which may form a continuation of the tubular guide 116. A telescopically sliding tube 126 is mounted on the extension, as explained in more detail below and illustrated in FIG. 6.

As in the embodiment of FIGS. 3 and 4, the interior of the body of the diffuser 106 in FIG. 5 is formed with guide vanes 120 having slope edges 122, 50 as to lead the lower end of the dip stick into the inner guide tube 116 to pass through the deflector cone 109. In this case, however, instead of terminating at the base 108 of the diffuser, the guide tube 116 has an extension 124 which passes through the base, towards the base of the tank, in the installed position.

Figure 6:
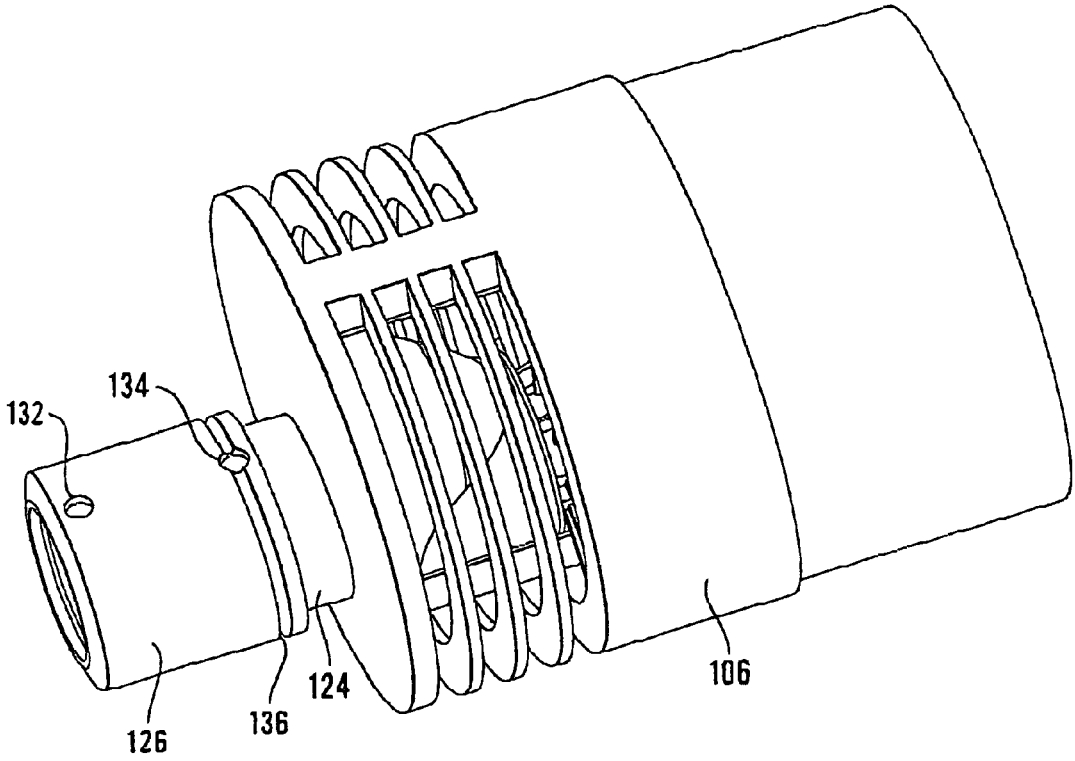
FIG. 6 is a perspective view from one side, corresponding to the view of FIG. 3, but showing the modified embodiment of FIG. 5.

Because the depth of tanks of this kind does, of course, vary in different installations, it is necessary to provide the extension 124 with an effectively adjustable length, and for this purpose, an outer telescopic piston member 126 which may have a relatively small end opening as shown in FIG. 6, or may be capped, is mounted on the tubular extension 124 so that in use it can slide downwardly on the extension, to contact the base of the tank. In order to retain it during assembly, a circumferential flange 128, FIG. 5 is provided on the lower end of the tubular extension 124, and the inner face of the upper end of the telescopic member 126 is provided with suitable cooperating retaining means. For example, the upper end of member 126 may be formed with an aperture 134 to receive a ball which is retained by a wire ring located in the groove 136 so that the ball abuts against the upper face of flange.

Bleed holes 130 in the extension member 124, and further bleed holes 132 in the piston member 126, are provided so that the guide tube 116 will be filled with fluid, to the same level as the rest of the tank. However, it will be appreciated that, once the base of the telescopic extension member 126 has contacted the bottom of the tank, the majority of the fluid flow into the fill tube will exit through the diffuser vanes.

On installation, the piston member 126 will drop onto the tank floor under the influence of gravity, and will also be urged into position by the hydraulic pressure differential if it is made with a closed or restricted end. As an alternative to the construction shown, however, additional spring loading may be incorporated, or a flexible bellows, rather than a solid tube, so as to ensure proper engagement between the base of the guide tube and the floor of the tank.

If the base of the piston member 126 is closed the floor of the tank can be protected from damage by the dipstick, and the extension also acts as a trap for foreign objects which may be accidentally dropped into the fill tube.

As an alternative to a telescopic extension the diffuser may be provided with a simple valve mechanism such as a ball or flap which can be deflected by the dip stick when it is inserted.

The invention claimed is:

1. A flow diffuser adapted to be fitted to the exit end of the fill tube of a fuel tank, having slot-like apertures which are arranged to extend substantially at right angles to the axis of the fill tube, and a deflector, in the base of the diffuser; the deflector being formed with an opening to allow the passage of a dip stick and the diffuser also including guide means arranged to guide the end of the dip stick into the opening, when it is inserted in the fill tube, the guide means comprising a plurality of circumferentially spaced, generally radially extending vanes, having inner edges which slope toward the inlet of the opening wherein the opening for the dip stick comprises a short inner tubular section which intersects the deflector and extends parallel to its axis, with the guide means situated above the inlet of the inner tubular section, and wherein the tubular section is provided with an extension below the base of the diffuser which is so arranged as to contact the base of the tank in an installed condition.

2. The diffuser according to claim 1 in which the extension is telescopic.

3. The diffuser according to claim 1, in which the extension is formed with bleed holes to ensure that it is properly filled with fluid as the tank is filled.

* * * * *